US005147227A

United States Patent [19]

Yurko

[11] Patent Number: 5,147,227

[45] Date of Patent: Sep. 15, 1992

[54] TERMINAL RETENTION DEVICE

[75] Inventor: Garold M. Yurko, Greensboro, N.C.

[73] Assignee: AMP Incorporated, Harrisburg, Pa.

[21] Appl. No.: 777,962

[22] Filed: Oct. 17, 1991

[51] Int. Cl.[5] ..... H01R 13/40

[52] U.S. Cl. ..... 439/733; 439/82

[58] Field of Search ..... 439/82, 83, 733, 736, 439/743, 745, 810, 885

[56] References Cited

U.S. PATENT DOCUMENTS

| | | | |
|---|---|---|---|
| 3,897,131 | 7/1975 | Stauffer | 439/733 X |
| 4,735,575 | 4/1988 | Shaffer | 439/82 |
| 5,035,656 | 7/1991 | Patel | 439/733 |

OTHER PUBLICATIONS

Drawing of AMP MATE-N-LOK socket for printed circuit header No. 350574.

*Primary Examiner*—Eugene F. Desmond

*Attorney, Agent, or Firm*—Bruce J. Wolstoncroft; Allan B. Osborne

[57] ABSTRACT

A retention device (50) for retaining a terminal (40) in a hole in a plastic housing is disclosed. The device (50) comprises two sets of outwardly projecting nibs (52) on a cylindrical section (44) of the terminal (40). Each nib (52) includes a flat edge surface (54) normal to the axis of the terminal (40).

2 Claims, 3 Drawing Sheets

TERMINAL RETENTION DEVICE

FIELD OF THE INVENTION

The present invention relates to retaining electrical terminals in plastic housings.

BACKGROUND OF THE INVENTION

It has been discovered that terminals pressed into passages or holes in plastic housings tend to work loose and shift locations so that one terminal may extend out of the housing at a different height than another. Accordingly, it is now proposed to increase the retention forces by placing reversely orientated nibs on the section of the terminal which engages the walls of the hole.

SUMMARY OF THE INVENTION

According to the present invention, a retention device for retaining a terminal in a hole in a plastic housing is provided wherein the device includes two sets of outwardly projecting nibs with each set spaced apart and spaced around a cylindrical section of the terminal. Further, each nib has a flat surface which is normal to the terminal and each set of nibs is oriented so that the flat surfaces on one set face the flat surfaces of the other set.

DESCRIPTION OF THE PRIOR ART

Figure 1:
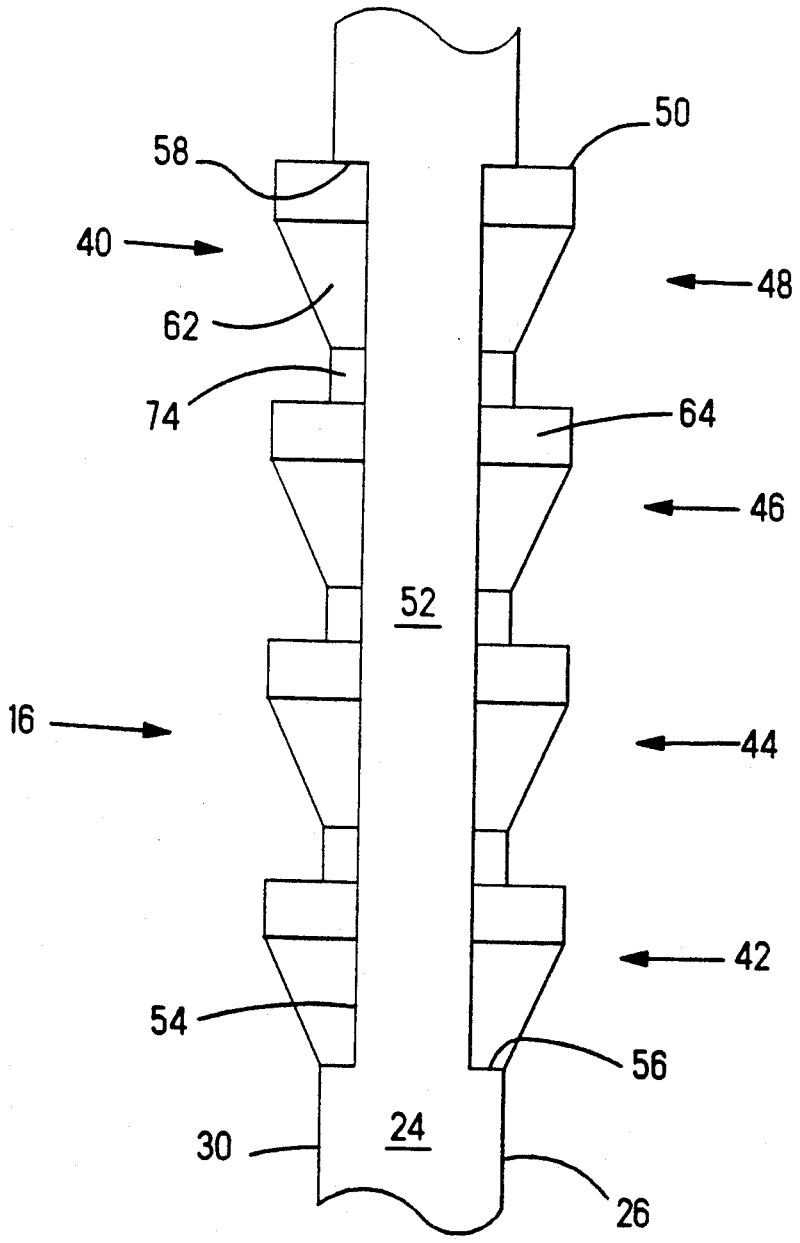
FIG. 1 (PRIOR ART)
FIG. 1 is a side view of a prior art contact element having a retention section thereon for mounting in holes in a connector housing.

The drawing in FIG. 1 is a circuit board contact element 24 having prior art retention portion 16 thereon for the purpose of mechanically retaining element 24 in a hole in a connector housing (not shown).

Retention portion 16 comprises pairs 42, 44, 46, 48 of opposed upsets 40. First pair 42 is closest to the end (not shown) of the element 24 which is inserted into the hole of the housing. Upsets 40 include distal tips 50 with the length between tips 50 of each pair 42–48 increasing from first pair 42 to fourth pair 48. Upsets 40 further include other structural features designed, in conjunction with the varying sizes, for being staked into an oblong hole (not shown) such that only the upsets 40 contact the flat walls thereof. The upsets 40 provides an incremental interference with the hole to retain element 24 therein and to reduce sliver formation. Upsets 40 are made by squeezing or pinching opposing edge portions towards each other. Elements 24 are made from any suitable metal used for electrical terminals such as brass, phosphor bronze and beryllium copper. Reference to U.S. Pat. No. 5,035,656 to Patel will provide complete details of this prior art retention device.

As noted in that patent, retention portion 16 is inserted into the hole so that the slanted sides engage the walls first and the increasing sizes of pairs 42–48 of upsets 40 ensure that each upset 24 firmly engages the wall.

DESCRIPTION OF THE PRESENT INVENTION

Figure 2:
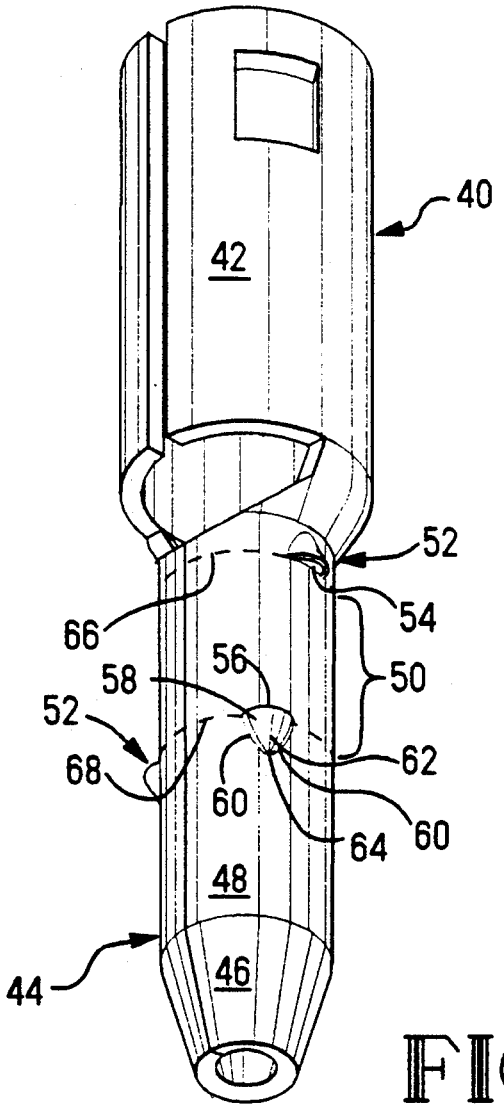
FIGS. 2 and 3 are views taken from opposite sides of a terminal with the retention devices of the present invention thereon.
Figure 3:
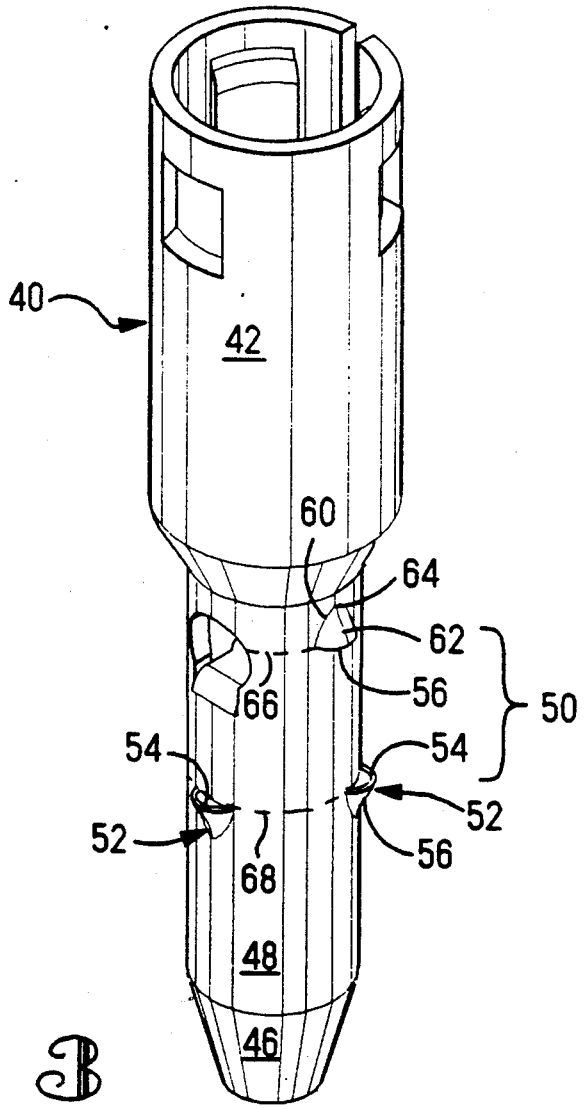

The drawings in FIGS. 2 and 3 showing a cylindrical, stamped and formed terminal 40 manufactured by AMP Incorporated for use in electrical connectors sold under the trademark MATE-N-LOK. The preferred material is phosphor bronze.

Terminal 40 includes a socket section 42 and a solder tail 44 of lesser diameter. Socket section 42 receives a mating pin.

A truncated tapered free end 46 eases the insertion of tail 44 into a hole in a plastic housing (not shown) and into a hole in a printed circuit board (not shown).

Shaft 48 of tail 44 extends between socket section 42 and free end 46 and carries retention device 50 which comprises two sets of retention nibs 52 of the present invention.

Each nib 52 is provided with a flat edge surface 54 which is normal to and projects laterally from shaft 48. As shown the outer perimeter 56 of nib 52 at surface 54 is arcuate. Each nib 52 further includes outer surface 58 which has a compound shape which slants longitudinally inwardly to meet shaft 48 at a predetermined distance from surface 54. Further, lateral edges 60 converge to meet at a longitudinal center line 62 at tip 64 of nib 52. The overall configuration of nib 52 can be likened to an arrowhead.

Nibs 52 are located on shaft 48 on two spaced apart circumferential locations indicated by upper and lower dashed lines 66,68 respectively. As shown, nibs 52 on respective lines 66,68 are not in line with each other but are offset or shifted in one or another lateral direction. Further, nibs 52 on one line 66,68 are oriented so that flat surfaces 54 face the nibs 52 on the other line 66,68.

In use, as tail section 44 is inserted into a hole in a plastic housing (not shown), flat edge surfaces 54 bite into the plastic material to increase the retention forces. Also nibs 52 on line 66 prevent terminals 40 from inadvertently moving into the hole further.

Testing of terminal 40 constructed in accordance with the present invention showed that the retention force was increased seventy five percent; i.e., from nine (9) pounds to fifteen and seven tenths (15.7) pounds relative to a like terminal having a pair of locking lances.

As can be discerned from the foregoing description, a retention device for retaining a terminal in a plastic housing has been disclosed. The device includes two sets of nibs projecting laterally outwardly from a section of the terminal and having flat edge surfaces normal to the axis of the terminal which bite into the plastic. Further, the nibs are at locations around the section at two spaced apart lines with the flat surfaces facing inwardly; i.e., towards the nibs on the other line. In this manner, the terminal is prevented from moving axially.

I claim:

1. A terminal retention device for retaining a terminal in a hole in a plastic housing, said device comprising two sets of outwardly projecting nibs with each set spaced apart and spaced around a cylindrical section of a terminal, said nibs having a flat edge surface axially normal to said terminal and each set of said nibs being oriented so that said flat surfaces of one set face said flat surfaces of said other set of nibs, said flat surfaces on at least one set of nibs adapted to dig into said plastic housing to prevent axial movement of said terminal.

2. The device of claim 1 wherein the nibs of one set are laterally offset relative to said nibs in said other set.

* * * * *